US011959186B2

(12) United States Patent
Wang

(10) Patent No.: US 11,959,186 B2
(45) Date of Patent: Apr. 16, 2024

(54) ELECTROPLATING METHOD AND ELECTROPLATING APPARATUS

(71) Applicant: CHANGXIN MEMORY TECHNOLOGIES, INC., Hefei (CN)

(72) Inventor: Ting Wang, Hefei (CN)

(73) Assignee: Changxin Memory Technologies, Inc., Hefei (CN)

( * ) Notice: Subject to any disclaimer, the term of this patent is extended or adjusted under 35 U.S.C. 154(b) by 326 days.

(21) Appl. No.: 17/455,982

(22) Filed: Nov. 22, 2021

(65) Prior Publication Data

US 2022/0162767 A1 May 26, 2022

Related U.S. Application Data

(63) Continuation of application No. PCT/CN2021/107904, filed on Jul. 22, 2021.

(30) Foreign Application Priority Data

Nov. 26, 2020 (CN) ..... 202011347709.0

(51) Int. Cl.

| | |
|---|---|
| ***C25D 21/10*** | (2006.01) |
| ***C25D 17/00*** | (2006.01) |
| ***C25D 21/04*** | (2006.01) |
| ***C25D 21/06*** | (2006.01) |

(52) U.S. Cl.
CPC ..... *C25D 21/10* (2013.01); *C25D 17/001* (2013.01); *C25D 21/04* (2013.01); *C25D 21/06* (2013.01)

(58) Field of Classification Search
CPC ..... C25D 17/001; C25D 21/04; C25D 21/10
See application file for complete search history.

(56) References Cited

U.S. PATENT DOCUMENTS

| | | | | |
|---|---|---|---|---|
| 7,727,863 | B1 * | 6/2010 | Buckalew | H01L 21/2885 257/E21.333 |
| 9,666,426 | B2 * | 5/2017 | Wang | C25D 17/008 |
| 10,407,709 | B2 * | 9/2019 | Di Carlo | C12Q 1/24 |
| 2009/0229988 | A1 * | 9/2009 | McMullin | C25D 5/10 205/109 |
| 2016/0047058 | A1 | 2/2016 | Ahmed et al. | |

(Continued)

FOREIGN PATENT DOCUMENTS

| | | | |
|---|---|---|---|
| CN | 1480988 | A | 3/2004 |
| CN | 1530471 | A | 9/2004 |
| CN | 101791494 | B | 5/2013 |

(Continued)

OTHER PUBLICATIONS

International Search Report as cited in PCT Application No. PCT/CN2021/107904 dated Sep. 13, 2021, 4 pages.

*Primary Examiner* — Brian W Cohen
(74) *Attorney, Agent, or Firm* — Cooper Legal Group, LLC

(57) ABSTRACT

Embodiments of the present application provide an electroplating method and an electroplating apparatus. The electroplating method includes: before putting wafers into an electroplating solution to undergo an electroplating process, adding particles into the electroplating solution, and applying ultrasonic waves to the electroplating solution, so as to remove bubbles in the electroplating solution by oscillation; removing the particles in the electroplating solution; and putting the wafers into the electroplating solution to undergo the electroplating process.

20 Claims, 5 Drawing Sheets

(56) References Cited

U.S. PATENT DOCUMENTS

2016/0122895 A1* 5/2016 James ..... C25D 3/22
205/109

FOREIGN PATENT DOCUMENTS

| | | | |
|---|---|---|---|
| CN | 110158143 | A | 8/2019 |
| CN | 112239878 | A | 1/2021 |
| KR | 20090060903 | A | 6/2009 |

* cited by examiner

ELECTROPLATING METHOD AND ELECTROPLATING APPARATUS

CROSS-REFERENCE TO RELATED APPLICATIONS

This application is a continuation application of International Patent Application No. PCT/CN2021/107904, filed on Jul. 22, 2021, which claims priority to Chinese Patent Application No. 202011347709.0, filed with the Chinese Patent Office filed on Nov. 26, 2020 and entitled "ELECTROPLATING METHOD AND ELECTROPLATING APPARATUS". International Patent Application No. PCT/CN2021/107904 and Chinese Patent Application No. 202011347709.0 are incorporated into the present application by reference in their entireties.

TECHNICAL FIELD

The present application relates to the field of semiconductor plating, and in particular, to an electroplating method and an electroplating apparatus.

BACKGROUND

Semiconductor devices have a high requirement for a signal transmission rate. Lines formed in the later stage of a manufacturing process are mainly copper. Copper is mainly deposited by employing an electrochemical method. Since copper is deposited in a liquid in the process of electrochemical deposition, small bubbles in the liquid can easily lead to the formation of pores in the process of wafer electroplating.

With the development of semiconductor devices, the size of semiconductor devices is gradually reduced, so is the size of circuits formed in semiconductor devices. At this point, if pores exist in lines, the signal transmission rate of semiconductor devices will be severely affected, resulting in a decrease in the yield of semiconductor products.

How to reduce bubbles in an electroplating solution to prevent the formation of pores in the process of wafer electroplating so as to increase the yield of wafer products is a problem urgent to be solved at present.

SUMMARY

An embodiment of the present application provides an electroplating method, including: before putting wafers into an electroplating solution to undergo an electroplating process, adding particles into the electroplating solution, and applying ultrasonic waves to the electroplating solution, so as to remove bubbles in the electroplating solution by oscillation; removing the particles in the electroplating solution; and putting the wafers into the electroplating solution to undergo the electroplating process.

An embodiment of the present application further provides an electroplating apparatus, including: a reaction module configured to contain an electroplating solution, the electroplating solution being used for performing an electroplating process on wafers put in the electroplating solution; an ultrasonic wave module configured to apply ultrasonic waves to the electroplating solution; an adding module configured to add particles into the electroplating solution and put the wafers into the electroplating solution or take the wafers out of the electroplating solution; a processing module configured to remove the particles in the electroplating solution; and a control module configured to control the operation of the ultrasonic wave module, the adding module and the processing module.

BRIEF DESCRIPTION OF DRAWINGS

One or more embodiments will be illustrated through the pictures in the accompanying drawings corresponding thereto, which do not constitute a scale limitation unless specifically stated otherwise.

DESCRIPTION OF EMBODIMENTS

Semiconductor devices have a high requirement for a signal transmission rate. Lines formed in the later stage of a manufacturing process are mainly copper. Copper is mainly deposited by employing an electrochemical method. Since copper is deposited in a liquid in the process of electrochemical deposition, small bubbles in the liquid can easily lead to the formation of pores in the process of wafer electroplating. With the development of semiconductor devices, the size of semiconductor devices is gradually reduced, so is the size of circuits formed in semiconductor devices. At this point, if pores exist in lines, the signal transmission rate of semiconductor devices will be severely affected, resulting in a decrease in the yield of semiconductor products.

In order to solve the aforementioned problem, a first embodiment of the present application provides an electroplating method, including: before putting wafers into an electroplating solution to undergo an electroplating process, adding particles into the electroplating solution, and applying ultrasonic waves to the electroplating solution, so as to remove bubbles in the electroplating solution by oscillation; removing the particles in the electroplating solution; and putting the wafers into the electroplating solution to undergo the electroplating process.

In order to make the object, technical solution and advantages of the embodiments of the present application clearer, each embodiment of the present application will be set forth in detail hereinafter with reference to the accompanying drawings. However, those of ordinary skill in the art can understand that many technical details are put forward in each embodiment of the present application in order for readers to better understand the present application. However, even without these technical details and various changes and modifications based on the following embodiments, the technical solution which is required to be protected by the present application can still be implemented. The division of the following embodiments is intended to facilitate description, and should not constitute any limitation to specific implementations of the present application. All the embodiments can be combined with and cite one another under the premise of no contradiction.

Figure 1:
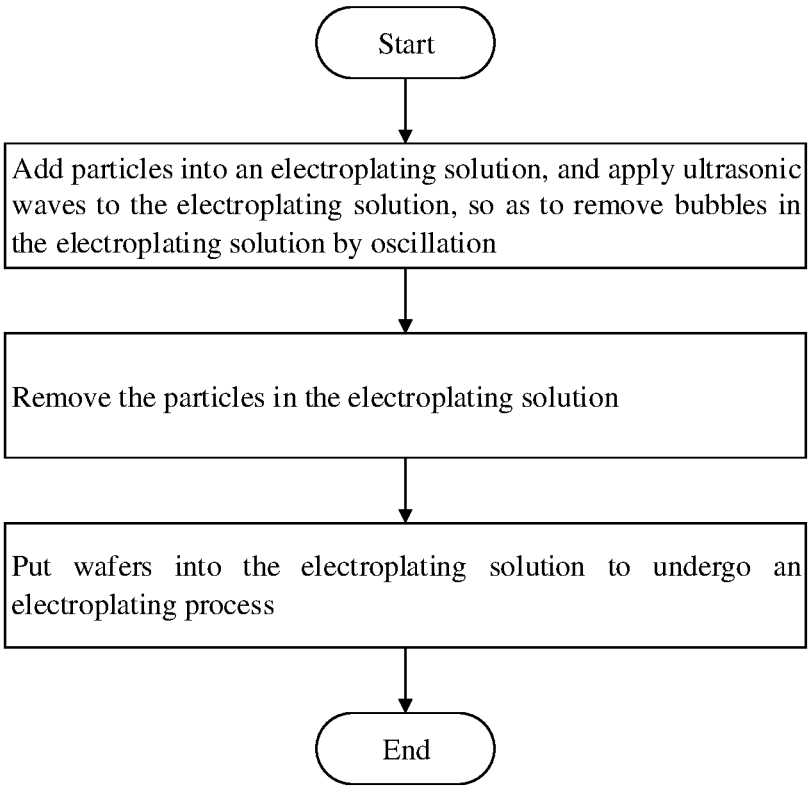
FIG. 1 is a schematic flow chart of an electroplating method according to a first embodiment of the present application.

FIG. 1 is a schematic flow chart of an electroplating method according to the present embodiment; and FIGS. 2 to 7 are schematic diagrams corresponding to the steps of the electroplating method according to the present embodiment.

The electroplating method according to the present embodiment will be described in detail with reference to the accompanying drawings.

Referring to FIG. 1, the electroplating method comprises the following steps:

(Step 101) adding particles into an electroplating solution, and applying ultrasonic waves to the electroplating solution, so as to remove bubbles in the electroplating solution by oscillation.

Figure 2:
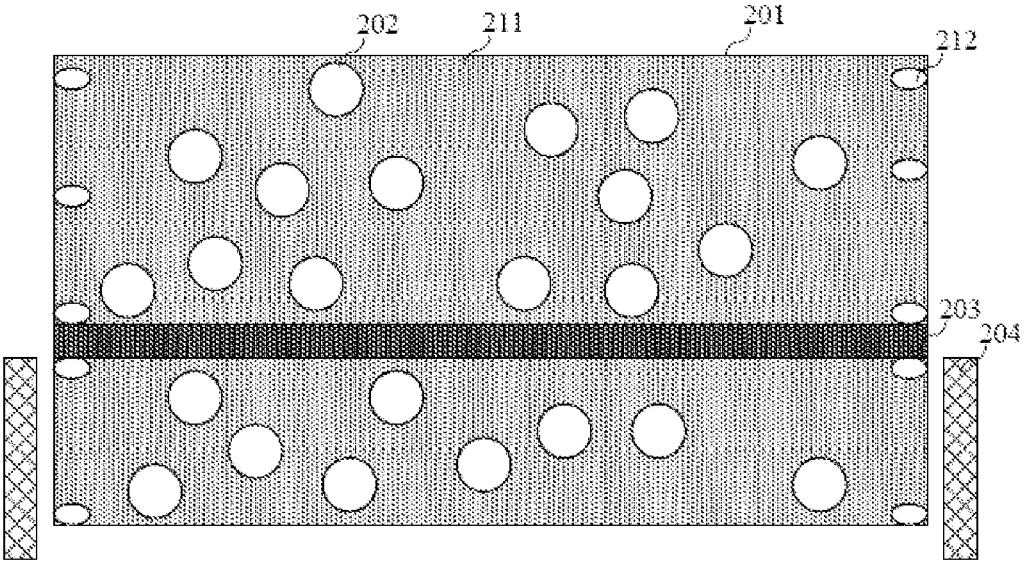
FIGS. 2 to 7 are schematic diagrams corresponding to the steps of the electroplating method according to the first embodiment of the present application.
Figure 3:
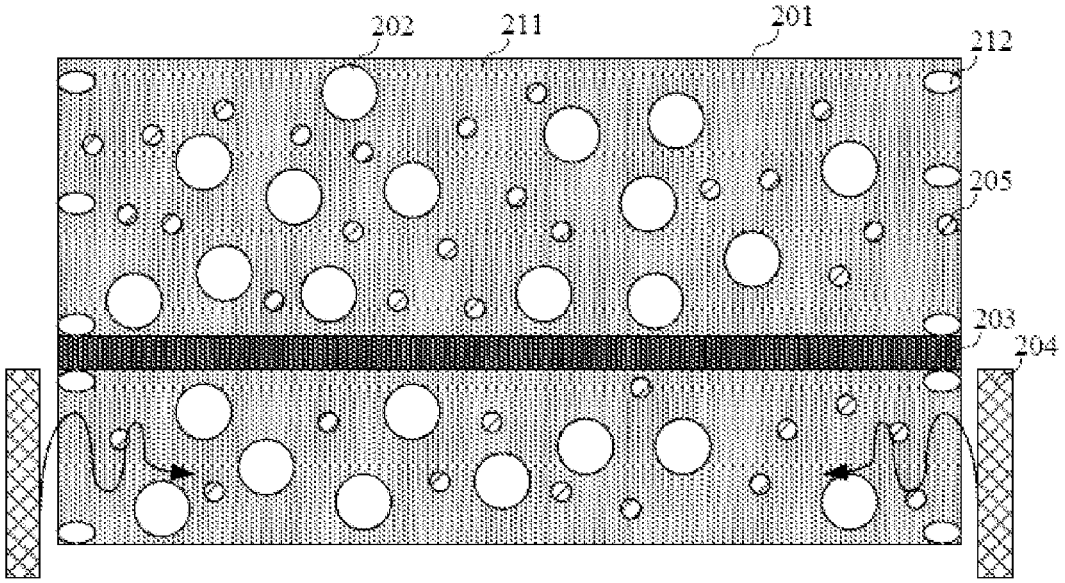
Figure 4:
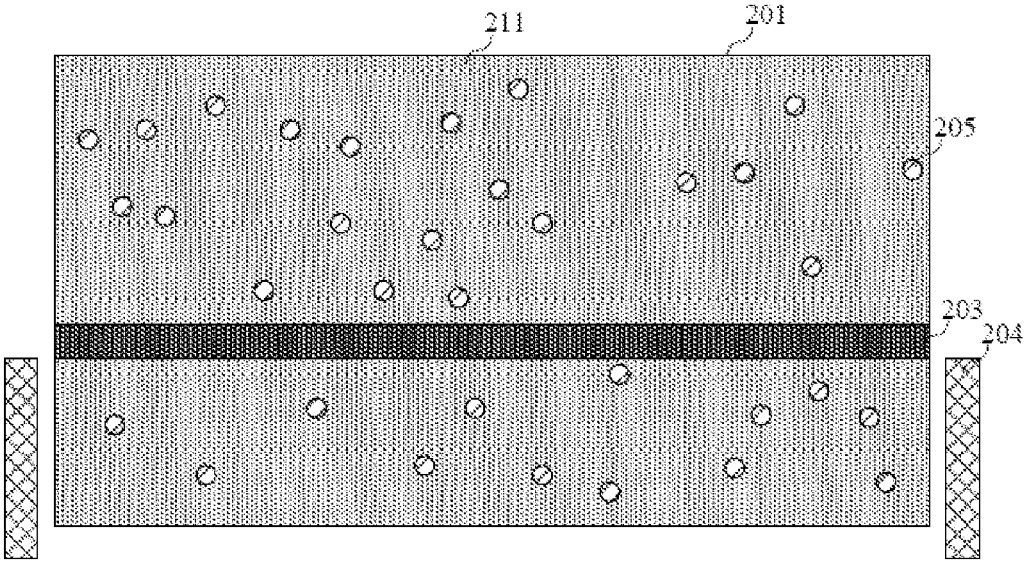

Referring to FIGS. 2 to 4, the electroplating apparatus 201 includes an electroplating solution 211 and a semipermeable membrane 203. The electroplating solution 211, which contains metal ions, is used for performing an electroplating process on wafers put into the electroplating solution 211. The semipermeable membrane 203 is used for allowing ions to permeate, so that the anions and the cations in the electroplating solution are separated from each other. The metal ions may be copper ions, silver ions or the like. In the present embodiment, the metal ions are copper ions, and are used for electroplating copper lines onto the wafers.

The electroplating apparatus 201 further includes an ultrasonic device 204, which is configured to emit ultrasonic waves into the electroplating solution 211, so as to oscillate the electroplating solution 211.

The electroplating solution 211 contains bubbles, e.g., suspending bubbles 202, large marginal bubbles (not shown in the drawings) and small marginal bubbles 212, or the like. In the present embodiment, the electroplating method according to the present embodiment is illustrated with the suspending bubbles 202 and the small marginal bubbles 212, which does not constitute a limitation to the present embodiment.

If the bubbles in the electroplating solution 211 are not removed, in the process of using the electroplating solution 211 with the bubbles to perform the electroplating process on the wafers, the metal for electroplating will have pores, which will severely affect a signal transmission rate of a semiconductor device. In a prior art, a method for removing bubbles in the electroplating solution 211 is only to oscillate the electroplating solution 211 by means of ultrasonic waves. However, only the suspending bubbles 202 and the large marginal bubbles (not shown in the drawings) can be removed by the ultrasonic waves alone, and the small marginal bubbles 212 cannot be removed. On this basis, according to the present embodiment, in the process of removing the bubbles, the particles are added into the electroplating solution 211.

Referring to FIG. 3, particles 205 are added into the electroplating solution 211, and the ultrasonic device 204 is switched on to emit ultrasonic waves into the electroplating solution 211.

By adding the particles 205 into the electroplating solution 211, as the ultrasonic waves oscillate the electroplating solution, the particles 205 are raised at the same time. The particles 205 raised in the electroplating solution 211 physically collide with the bubbles in the electroplating solution during suspension and motion, removing the suspending bubbles 202 and the large marginal bubbles (not shown in the drawings) as well as the small marginal bubbles 212 in the electroplating solution, and consequently, all the bubbles in the electroplating solution are removed. For a schematic diagram of the electroplating apparatus 201 after the removal of the bubbles, refer to FIG. 4.

In the present embodiment, a frequency of the ultrasonic waves is 80 kHz to 120 kHz, e.g., 90 kHz, 100 kHz or 110 kHz; and a sound intensity of the ultrasonic waves is 10 $W/cm^2$ to 20 $W/cm^2$, e.g., 12 $W/cm^2$, 14 $W/cm^2$, 16 $W/cm^2$ or 18 $W/cm^2$. By ensuring that the ultrasonic waves emitted by the ultrasonic device 204 have an appropriate frequency and sound intensity, the particles 205 in the electroplating solution 211 are uniformly dispersed, increasing the probability of the particles 205 physically colliding with the bubbles in the electroplating solution, and consequently, the removal of the suspending bubbles 202, the large marginal bubbles and the small marginal bubbles 212 is achieved.

In the present embodiment, the particles 205 added are charged particles, which can be subsequently removed by adsorption due to electric charges.

In addition, the charged particles added in the present embodiment are electrically weak particles, which have weak electron-donating groups or weak electron-withdrawing groups, e.g., hydroxyl groups, carboxyl groups and other groups. Since the particles 205 added are charged particles, the particles 205 added can be conveniently removed subsequently. Thus, it can be ensured that an influence on the acidity or basicity of the electroplating solution 211 can be ignored in the process of removing the electrically weak particles, preventing an environmental influence of the electroplating solution 211 on the subsequent performance of the electroplating process on the wafers.

In one example, the electrically weak particles at least include carbon nanotubes. Further, the size of the carbon nanotubes is 2 nm to 20 nm, e.g., 4 nm, 8 nm, 12 nm or 16 nm.

Continuing to refer to FIG. 1, (Step 102) removing the particles in the electroplating solution.

Specifically, after the ultrasonic waves are switched off, the particles 205 in the electroplating solution 211 are removed.

Figure 5:
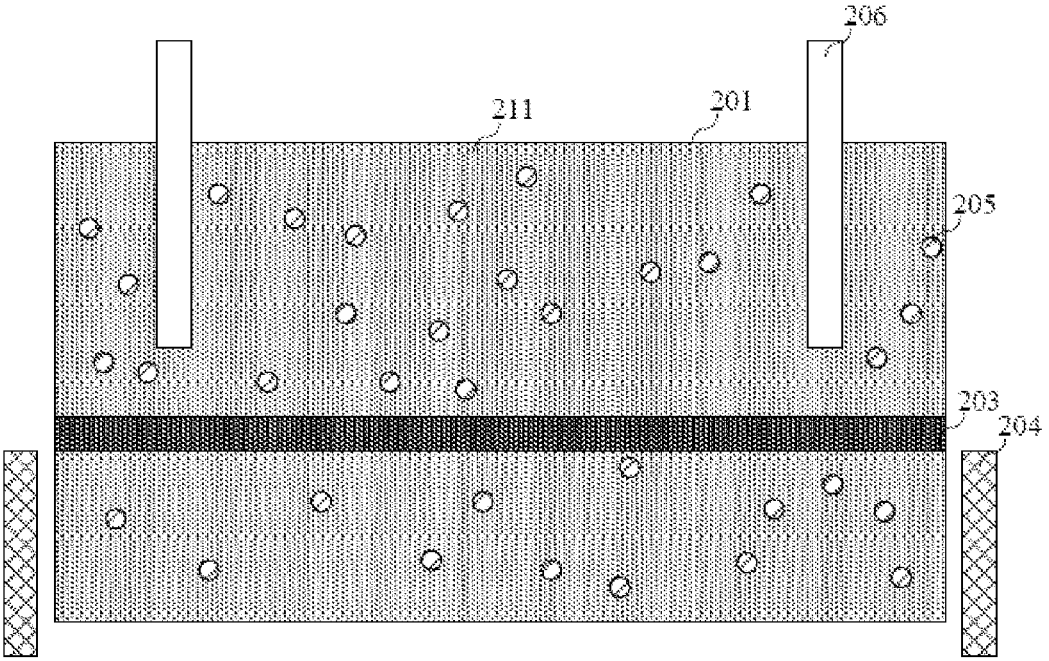
Figure 6:
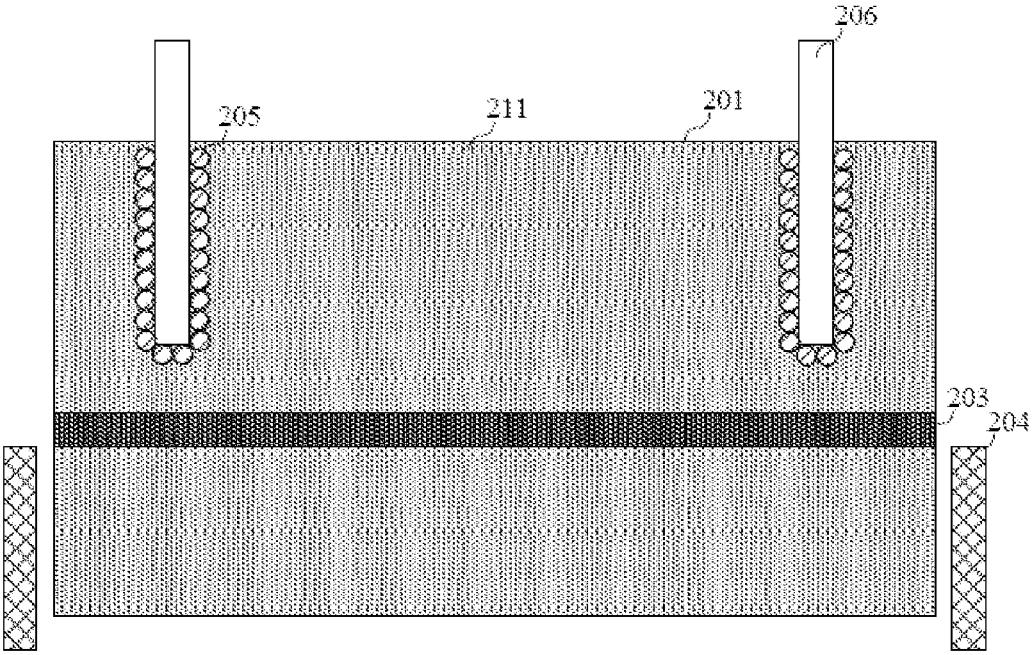
Figure 7:
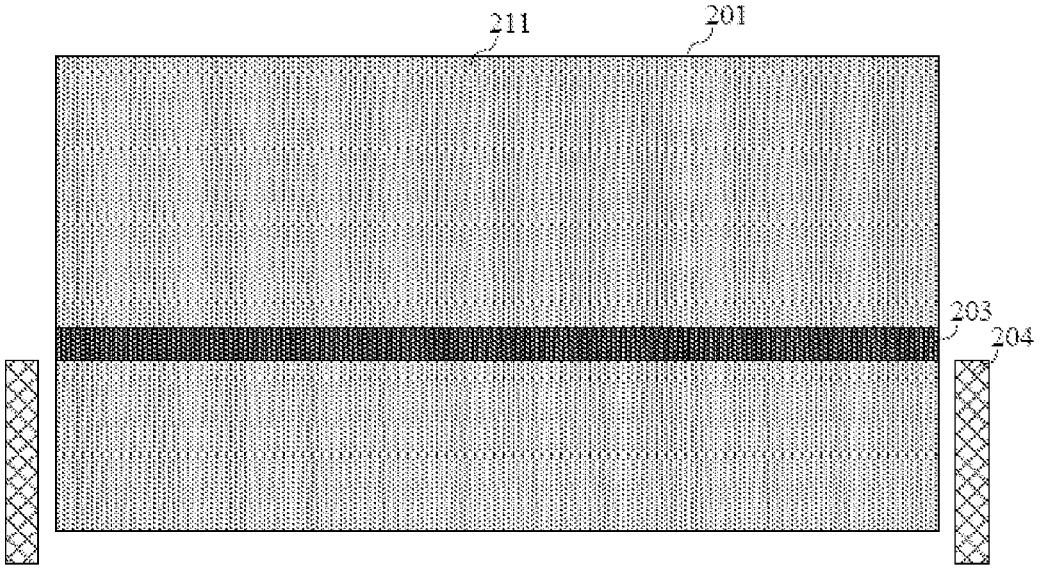

Referring to FIGS. 5 to 7, in the present embodiment, the step of removing the particles 205 in the electroplating solution 211 includes: after switching off the ultrasonic waves, before putting wafers into the electroplating solution 211 to undergo an electroplating process, inserting electrified polar plates 206 into the electroplating solution to remove the electrically weak particles in the electroplating solution 211 by adsorption.

Since the particles 205 added in the present embodiment are charged particles, the particles 205 in the electroplating solution 211 can be removed by inserting the electrified polar plates 206 into the electroplating solution 211. In addition, since the particles 205 added in the present embodiment are electrically weak particles, it is required to ensure a voltage applied to the electrified polar plates 206, so as to ensure that all the particles 205 are taken out.

In the present embodiment, the voltage applied to the electrified polar plates 206 is 20 V to 50 V, e.g., 25 V, 30 V, 35 V, 40 V or 45 V. The electrified polar plates 206 require a certain threshold voltage to effectively adsorb the electrically weak particles, so as to prevent the situation where impurities are brought into the electroplating process due to an influence of unabsorbed electrically weak particles on the electroplating process for the wafers. In addition, since metal ions are contained in the electroplating solution, and the application of voltage to the electrified polar plates 206 will cause transient electroplating, an excessive voltage will result in excessive electroplating reaction, increasing material costs and affecting the stability of metal ion content. That is, if the voltage applied to the electrified polar plates 206 is less than 20 V, it will easily lead to incomplete removal of the particles 205; and if the voltage applied to the electrified polar plates 206 is greater than 50 V, the electrified polar plates 206 will cause excessive electroplating reaction, thus affecting the stability of the metal ions in the electroplating solution 211.

Continuing to refer to FIG. 1, (Step 103) putting wafers into the electroplating solution to undergo an electroplating process.

Specifically, the step of putting wafers into the electroplating solution 211 to undergo an electroplating process includes: immersing the wafers into the electroplating solution 211 in an inclined state. By immersing the wafers into the electroplating solution in the inclined state, bubbles produced by surfaces of the wafers can be expelled by the action of buoyancy and wave pushing in the process of inclined immersion, preventing the wafers from producing bubbles in the process of immersion.

In addition, the present embodiment is suitable for being performed before wafers are put into the electroplating solution 211 to undergo the electroplating process, i.e., before a first batch of wafers is put into the electroplating apparatus to undergo the electroplating process. In addition, the steps before putting wafers into the electroplating solution 211 to perform the electroplating process includes: after a previous batch of wafers completes the electroplating process and is taken out of the electroplating solution 211 and before a next batch of wafers is put into the electroplating solution 211 to undergo the electroplating process. That is, the aforementioned electroplating method is also suitable for being intermittently performed when the electroplating apparatus is used to perform the electroplating process on different batches of wafers. By employing such an arrangement, it can be ensured that bubbles in the electroplating solution have been removed each time before the electroplating process is performed on wafers.

Compared with the related art, by ultrasonically oscillating the electroplating solution, the electroplating method can remove the suspending bubbles and the large marginal bubbles in the electroplating solution, but cannot remove the small marginal bubbles. By adding the particles into the electroplating solution, as the ultrasonic waves oscillate the electroplating solution, the particles are raised at the same time. The particles raised in the electroplating solution physically collide with the small marginal bubbles during suspension and motion, removing the small marginal bubbles in the electroplating solution, and consequently, all the bubbles in the electroplating solution are removed. Before the electroplating process is performed, the electrically weak particles in the electroplating solution are removed by adsorption, so as to eliminate the influence of the particles removing the bubbles in the electroplating solution on the electroplating process.

The division of the various steps above is merely intended to make description clear, and during implementation, the steps can be combined into one step or certain steps can be divided, decomposed into a plurality of steps, both of which fall into the protection scope of the present patent as long as the same logic relation is contained. The addition of inessential modifications or the introduction of inessential designs into the flow which does not change the core designs of the flow shall fall into the protection scope of the present patent.

A second embodiment of the present application relates to an electroplating apparatus.

Figure 8:
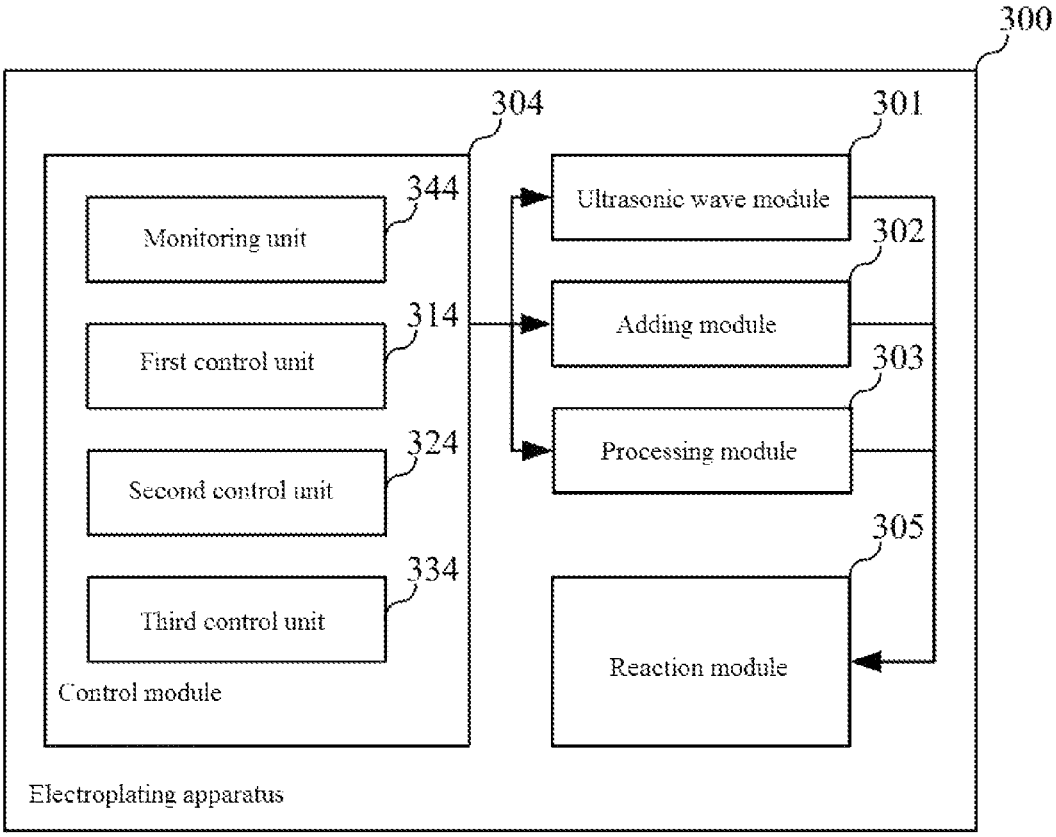
FIG. 8 and FIG. 9 are schematic structural diagrams of an electroplating apparatus according to a second embodiment of the present application.
Figure 9:
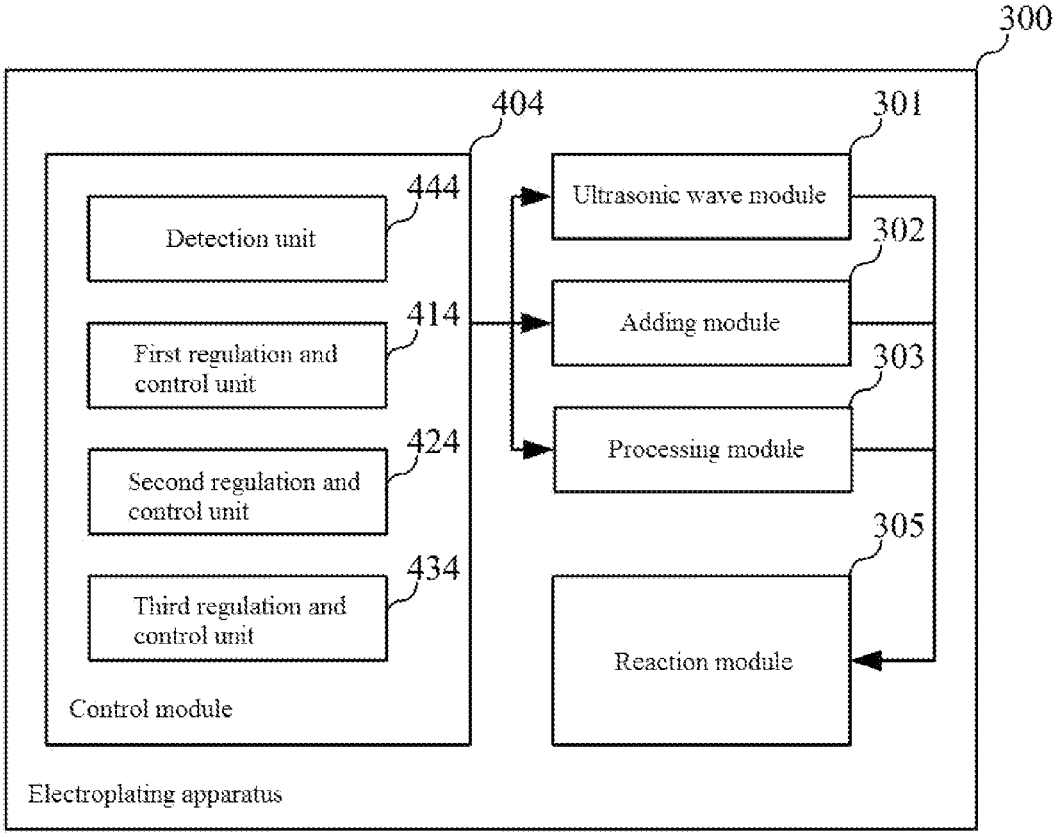

FIG. 8 and FIG. 9 are schematic structural diagrams of the electroplating apparatus according to the present embodiment. The electroplating apparatus according to the present embodiment will be described in detail with reference to the accompanying drawings, and the parts which are identical with or correspond to those in the first embodiment will not be described in detail below.

Referring to FIG. 8, the electroplating apparatus 300 includes:

a reaction module 305 configured to contain an electroplating solution, the electroplating solution being used for performing an electroplating process on wafers put in the electroplating solution.

Specifically, the electroplating solution, which contains metal ions, is used for performing the electroplating process on the wafers put into the electroplating solution. The metal ions may be copper ions, silver ions or the like. In the present embodiment, the metal ions are copper ions, and are used for electroplating copper lines onto the wafers.

an ultrasonic wave module 301 configured to apply ultrasonic waves to the electroplating solution, so as to oscillate the electroplating solution.

In the present embodiment, a frequency of the ultrasonic waves emitted by the ultrasonic wave module 301 is 80 kHz to 120 kHz, e.g., 90 kHz, 100 kHz or 110 kHz; and a sound intensity of the ultrasonic waves emitted by the ultrasonic wave module 301 is 10 W/cm$^2$ to 20 W/cm$^2$, e.g., 12 W/cm$^2$, 14 W/cm$^2$, 16 W/cm$^2$ or 18 W/cm$^2$. By ensuring that the ultrasonic waves emitted by the ultrasonic wave module 301 have an appropriate frequency and sound intensity, particles in the electroplating solution are uniformly dispersed, ensuring that the particles physically collide with bubbles in the electroplating solution, and consequently, the removal of the small marginal bubbles is achieved.

an adding module 302 configured to add particles into the electroplating solution and put the wafers into the electroplating solution or take the wafers out of the electroplating solution.

It should be noted that a method of the adding module 302 putting the wafers into the electroplating solution or taking the wafers out of the electroplating solution includes: using the adding module 302 to immerse the wafers into the electroplating solution in an inclined state or take the wafers out of the electroplating solution in the inclined state. By immersing the wafers into the electroplating solution in the inclined state, bubbles produced by surfaces of the wafers can be expelled by the action of buoyancy and wave pushing in the process of immersion, preventing the wafers from producing bubbles in the process of immersion.

a processing module 303 configured to remove the particles in the electroplating solution.

a control module 304 configured to control the operation of the ultrasonic wave module 301, the adding module 302 and the processing module 303.

In the present embodiment, the particles added into the electroplating solution by the adding module 302 are electrically weak particles, which have weak electron-donating groups or weak electron-withdrawing groups, e.g., hydroxyl groups, carboxyl groups and other groups. Since the particles added are electrically weak particles, the electrically weak particles can be removed before the electroplating process, and moreover, it is ensured that an influence on the acidity or basicity of the electroplating solution can be ignored in the process of removing the electrically weak particles, preventing an environmental influence of the electroplating solution on the subsequent performance of the electroplating process on the wafers.

Accordingly, a method of the processing module 303 removing the particles in the electroplating solution includes: the processing module 303 inserting electrified polar plates into the electroplating solution, and the electrified polar plates adsorbing the electrically weak particles, so that the electrically weak particles in the electroplating solution are removed. It should be noted that a voltage applied to the electrified polar plates is required to ensure the complete removal of the electrically weak particles without causing excessive electroplating reaction.

Continuing to refer to FIG. 8, in one example, the control module 304 includes: a monitoring unit 344 configured to acquire a preset duration of the ultrasonic wave module 301 applying ultrasonic waves and a time interval between two successive applications of ultrasonic waves; a first control unit 314 configured to control the ultrasonic wave module 301 to apply ultrasonic waves for the preset duration after a previous batch of wafers completes the electroplating process and is taken out of the electroplating solution; a second control unit 324 configured to control the adding module 302 to add particles into the electroplating solution after the previous batch of wafers completes the electroplating process and is taken out of the electroplating solution; and a third control unit 334 configured to control the processing module 303 to remove the particles in the electroplating solution before a next batch of wafers is put into the electroplating solution to undergo the electroplating process.

Actions of the electroplating apparatus 300 to perform the electroplating process on different batches of wafers are acquired by the duration of the ultrasonic wave module 301 applying ultrasonic waves and times of switching on ultrasonic waves, so as to control the operation of the ultrasonic wave module 301, the adding module 302 and the processing module 303. This is suitable for being intermittently performed when the electroplating apparatus 300 performs the electroplating process on different batches of wafers.

Referring to FIG. 9, in another example, the control module 304 includes: a detection unit 444 configured to detect an action of putting wafers into the electroplating solution or taking wafers out of the electroplating solution; a first regulation and control unit 414 configured to control the ultrasonic wave module 301 to switch on ultrasonic waves when the action of taking wafers out of the electroplating solution is detected; a second regulation and control unit 424 configured to control the adding module 302 to add particles into the electroplating solution when the action of taking wafers out of the electroplating solution is detected; and a third regulation and control unit 434 configured to control the ultrasonic wave module 301 to switch off ultrasonic waves and the processing module 303 to remove the particles in the electroplating solution when the action of putting wafers into the electroplating solution is detected.

The control over the operation of the ultrasonic wave module 301, the adding module 302 and the processing module 303 by detecting the action of putting wafers into the electroplating solution or taking wafers out of the electroplating solution in real time is suitable for being performed before wafers are put into the electroplating solution to undergo the electroplating process, i.e., before a first batch of wafers is put into the electroplating apparatus 300 to undergo the electroplating process, and is also suitable for being intermittently performed when the electroplating apparatus 300 is used to perform the electroplating process on different batches of wafers.

Compared with the related art, by utilizing ultrasonic waves emitted by the ultrasonic wave module to oscillate the electroplating solution, the electroplating apparatus can remove suspending bubbles and large marginal bubbles in the electroplating solution, but cannot remove small marginal bubbles. By utilizing the adding module to add the particles into the electroplating solution, as the ultrasonic waves oscillate the electroplating solution, the particles are raised at the same time. The particles raised in the electroplating solution physically collide with the small marginal bubbles during suspension and motion, removing the small marginal bubbles in the electroplating solution, and consequently, all the bubbles in the electroplating solution are removed. Before the electroplating process is performed, the control module is configured to control the processing module to remove the particles in the electroplating solution, so as to eliminate the influence of the particles removing the bubbles in the electroplating solution on the electroplating process.

It's worth mentioning that every module involved in the present embodiment is a logic module, and in practical application, a logic unit may be implemented by a physical unit, one part of a physical unit or a combination of a plurality of physical units. In addition, in order to highlight the innovative parts of the present application, units which do not have close relation with the solution of the technical problem put forward by the present application are not introduced into the present embodiment, but this doesn't mean that no other units exist in the present embodiment.

Since the first embodiment and the present embodiment correspond to each other, the present embodiment and the first embodiment can be implemented in cooperation with each other. The related technical details mentioned in the first embodiment remain valid in the present embodiment. The technical effect achieved in the first embodiment can also be achieved in the present embodiment, and therefore will not be repeated herein in order to reduce repetition. Accordingly, the related technical details mentioned in the present embodiment can also be applied in the first embodiment.

Those of ordinary skill in the art should understand that the aforementioned embodiments are specific embodiments implementing the present application. However, in practical application, various changes can be made to the embodiments in terms of forms and details without departing from the spirit and scope of the present application.

What is claimed is:

1. An electroplating method, comprising:

before putting wafers into an electroplating solution to undergo an electroplating process, adding particles into the electroplating solution, and applying ultrasonic waves to the electroplating solution, so as to remove bubbles in the electroplating solution by oscillation;

removing the particles in the electroplating solution; and putting the wafers into the electroplating solution to undergo the electroplating process.

2. The electroplating method of claim 1, wherein the step of putting the wafers into the electroplating solution to undergo the electroplating process is performed after a previous batch of wafers completes the electroplating process and is taken out of the electroplating solution and before a next batch of wafers is put into the electroplating solution to undergo the electroplating process.

3. The electroplating method of claim 1, wherein a frequency of the ultrasonic waves is 80 kHz to 120 kHz, and a sound intensity of the ultrasonic waves is 10 $W/cm^2$ to 20 $W/cm^2$.

4. The electroplating method of claim 1, wherein the particles are electrically weak particles, which have weak electron-donating groups or weak electron-withdrawing groups.

5. The electroplating method of claim 4, wherein the electrically weak particles at least comprise carbon nanotubes.

6. The electroplating method of claim 5, wherein a size of the carbon nanotubes is 2 nm to 20 nm.

7. The electroplating method of claim 4, wherein the step of removing the particles in the electroplating solution comprises:

after switching off the ultrasonic waves, before putting the wafers into the electroplating solution to undergo the electroplating process, inserting electrified polar plates into the electroplating solution to remove the electrically weak particles in the electroplating solution by adsorption.

8. The electroplating method of claim 7, wherein a voltage applied to the electrified polar plates is 20 V to 50 V.

9. The electroplating method of claim 1, wherein the step of putting the wafers into the electroplating solution to undergo the electroplating process comprises: immersing the wafers into the electroplating solution in an inclined state.

10. An electroplating apparatus, comprising:

a reaction module configured to contain an electroplating solution, the electroplating solution being used for performing an electroplating process on wafers put in the electroplating solution;

an ultrasonic wave module configured to apply ultrasonic waves to the electroplating solution;

an adding module configured to add particles into the electroplating solution and put the wafers into the electroplating solution or take the wafers out of the electroplating solution;

a processing module configured to remove the particles in the electroplating solution; and a control module configured to control operation of the ultrasonic wave module, the adding module and the processing module, wherein the control module comprises:

a monitoring unit configured to acquire a preset duration of the ultrasonic wave module applying the ultrasonic waves and a time interval between two successive applications of the ultrasonic waves;

a first control unit configured to control the ultrasonic wave module to apply the ultrasonic waves for the preset duration after a previous batch of wafers completes the electroplating process and is taken out of the electroplating solution;

a second control unit configured to control the adding module to add the particles into the electroplating solution after the previous batch of wafers completes the electroplating process and is taken out of the electroplating solution; and a third control unit configured to control the processing module to remove the particles in the electroplating solution before a next batch of wafers is put into the electroplating solution to undergo the electroplating process.

11. The electroplating apparatus of claim 10, wherein the particles are electrically weak particles, which have weak electron-donating groups or weak electron-withdrawing groups.

12. The electroplating apparatus of claim 10, wherein the adding module is configured to immerse the wafers into the electroplating solution in an inclined state.

13. The electroplating apparatus of claim 11, wherein the processing module inserts electrified polar plates into the electroplating solution, so as to remove the electrically weak particles in the electroplating solution.

14. The electroplating apparatus of claim 10, wherein a frequency of the ultrasonic waves emitted by the ultrasonic wave module is 80 kHz to 120 kHz, and a sound intensity of the ultrasonic waves emitted by the ultrasonic wave module is 10 W/cm$^2$ to 20 W/cm$^2$.

15. The electroplating apparatus of claim 11, wherein a frequency of the ultrasonic waves emitted by the ultrasonic wave module is 80 kHz to 120 kHz, and a sound intensity of the ultrasonic waves emitted by the ultrasonic wave module is 10 W/cm$^2$ to 20 W/cm$^2$.

16. The electroplating apparatus of claim 12, wherein a frequency of the ultrasonic waves emitted by the ultrasonic wave module is 80 kHz to 120 kHz, and a sound intensity of the ultrasonic waves emitted by the ultrasonic wave module is 10 W/cm$^2$ to 20 W/cm$^2$.

17. An electroplating apparatus, comprising:

a reaction module configured to contain an electroplating solution, the electroplating solution being used for performing an electroplating process on wafers put in the electroplating solution;

an ultrasonic wave module configured to apply ultrasonic waves to the electroplating solution;

an adding module configured to add particles into the electroplating solution and put the wafers into the electroplating solution or take the wafers out of the electroplating solution;

a processing module configured to remove the particles in the electroplating solution; and a control module configured to control operation of the ultrasonic wave module, the adding module and the processing module, wherein the control module comprises:

a detection unit configured to detect an action of putting wafers into the electroplating solution or an action of taking wafers out of the electroplating solution;

a first regulation and control unit configured to control the ultrasonic wave module to switch on the ultrasonic waves when the action of taking wafers out of the electroplating solution is detected;

a second regulation and control unit configured to control the adding module to add the particles into the electroplating solution when the action of taking wafers out of the electroplating solution is detected; and a third regulation and control unit configured to control the ultrasonic wave module to switch off the ultrasonic waves and the processing module to remove the particles in the electroplating solution when the action of putting wafers into the electroplating solution is detected.

18. The electroplating apparatus of claim 17, wherein the particles are electrically weak particles, which have weak electron-donating groups or weak electron-withdrawing groups.

19. The electroplating apparatus of claim 17, wherein the adding module is configured to immerse the wafers into the electroplating solution in an inclined state.

20. The electroplating apparatus of claim 17, wherein a frequency of the ultrasonic waves emitted by the ultrasonic wave module is 80 kHz to 120 kHz, and a sound intensity of the ultrasonic waves emitted by the ultrasonic wave module is 10 W/cm$^2$ to 20 W/cm$^2$.

* * * * *